United States Patent [19]

Hayami et al.

[11] 4,062,700

[45] Dec. 13, 1977

[54] METHOD FOR PRODUCING A STEEL SHEET WITH DUAL-PHASE STRUCTURE COMPOSED OF FERRITE- AND RAPIDLY-COOLED-TRANSFORMED PHASES

[75] Inventors: Satohiro Hayami, Yokohama; Takashi Furukawa, Machida; Yoshihiko Takeoka, Kawasaki, all of Japan

[73] Assignee: Nippon Steel Corporation, Tokyo, Japan

[21] Appl. No.: 645,473

[22] Filed: Dec. 30, 1975

[30] Foreign Application Priority Data

Dec. 30, 1974 Japan ..... 50-1028

[51] Int. Cl.[2] ..... C21D 7/14

[52] U.S. Cl. ..... 148/12.3; 148/12 F; 148/134

[58] Field of Search ..... 148/36, 12.3, 12 F, 148/37, 39, 134

[56] References Cited

U.S. PATENT DOCUMENTS

| | | | |
|---|---|---|---|
| 3,826,691 | 7/1974 | Melloy et al. | 148/12 F |
| 3,885,997 | 5/1975 | Bucher et al. | 148/12.3 |
| 3,912,549 | 10/1975 | Gunto et al. | 148/12 C |
| 3,947,293 | 3/1976 | Takechi et al. | 148/12 F |
| 3,954,516 | 5/1976 | Hu | 148/12 C |

*Primary Examiner*—Arthur J. Steiner
*Attorney, Agent, or Firm*—Wenderoth, Lind & Ponack

[57] ABSTRACT

A method for producing a steel sheet of dual-phase structure composed of ferrite phase and transformed phase (or phases) produced by rapid cooling, which comprises isotropically dispersing a carbon concentrated phase by a pretreatment of the steel sheet and continuously annealing the steel sheet thus pretreated in the alpha-gamma range, followed by cooling at a rate not larger than about 10000° C/min., as defined herein.

8 Claims, 4 Drawing Figures a: Alpha-gamma-range continuous annealing · air cooling b: Alpha-gamma-range annealing (750°C one hour) · furnace cooling → Alpha-gamma-range continuous annealing · air cooling c: Annealing in the single alpha range (650°C one hour) · furnace cooling → Alpha-gamma-range continuous annealing · air cooling Alpha-gamma-range continuous annealing: 800°C for 5 minutes X: Without pretreatment Y: Strength and elongation range for comparative steels in Table 5

Numerical figures correspond to the number of the test pieces in Table 4.

2μ

2μ

METHOD FOR PRODUCING A STEEL SHEET WITH DUAL-PHASE STRUCTURE COMPOSED OF FERRITE- AND RAPIDLY-COOLED-TRANSFORMED PHASES

BACKGROUND OF THE INVENTION

1. Description of the Prior Art

In recent years various low-alloy high-strength steel sheets have been under development, and the present inventors have also invented a high-silicon and high-manganese steel ("AN ISOTROPIC AND HIGH-STRENGTH HIGH-SILICON STEEL SHEET" U.S.P. Ser. No. 477,098, British Patent Application No. 25798/74, German Patent Application P 24 27 837.3, French Patent Application No. 74/19982, Italian Patent Application No. 23832A/74, Swedish Patent Application No. 74 07542-5 and Brazilian Patent Application No. 4792P/74).

The high-silicon and high-manganese steel of U.S.P. Ser. No. 477,098 comprises 0.03 to 0.15% carbon, 0.7 to 2.3% silicon and 0.7 to 2.0% manganese, the balance being iron and unavoidable impurities. The ratio of silicon/manganese in this steel is between 0.6 and 1.5, preferably between 0.8 and 1.1, and the content of sulfur is maintained as low as possible below that usually present as an unavoidable impurity, preferably not more than 0.01%. This steel may also contain one or more of Cr, Nb, V, Ti, Al and Cu in amounts of not more than 0.5% for Cr and Cu, not more than 0.4% for each of Nb, V and Ti, and not more than 0.1% for Al. Further, this steel may contain Ce and/or Zr in an amount so as to attain a Ce/S ratio of 1.5 to 2.0 and a Zr/S ratio of greater than 2.

This steel is a high-silicon and high-manganese steel useable as both hot and cold rolled steel sheets, in which the weight percent ratio of Si/Mn is about 1 : 1 and which shows a ductility and concomitant tensile strength superior to that of various high-strength steel sheets conventionally available. Especially noticeable is that the steel in the state of "dual-phase" structure, consisting of ferrite- and martensite (and/or bainite) phases, formed after continuous annealing in the alphagamma temperature range followed by air cooling, provides a high-strength high-ductility steel sheet of up to 90 kg/mm grade in tensile strength. The dual-phase steel is characteristic of low yield strength (which can easily be raised by a low-temperature reheating), high tensile strength, a good elongation.

As for a somewhat similarly structured steel, Japanese Patent Publication No. Sho 46-9542 (U.S. Pat. No. 3,378,360) (A METHOD FOR PRODUCING A HIGH TENSILE STRENGTH THIN STEEL SHEET) may be mentioned.

According to the method disclosed by this prior art, it is essential that very rapid cooling such as water quenching from the alpha-gamma range is carried out [within 0.8 second from the alpha-gamma range to the Ms (start of martensitic transformation) temperature, hence with a cooling of about 3000°–40000° C/min.] in a continuous annealing process in order to assure a high level of strength.

Such drastic cooling as by water quenching requires additional equipment and increased production cost, and causes further trouble such that the shape of the steel sheet tends to be deformed due to the severe thermal contraction strain, requiring proper shape-correction devices. In addition to these, it is rather difficult to attain a high level of ductility by the water-quenching method, even though a high level of strength can be easily obtained. Thus it has been generally difficult to obtain a good combination of high strength (up to about 80 kg/mm$^2$) practically applicable to press forming and high ductility.

Examples in Table 1 illustrate these high-strength low-ductility materials.

Table 1

Strength and Ductility of High-Strength Steel Sheets obtained by the Alpha-Gamma-Range Heating and Water Quenching by Prior Art (According to Japanese Patent Publication No. Sho 46–9542; U.S. Pat. No. 3,378,360)

| Composition (weight %) | | | | | Sheet Thickness | Yield Strength (0.2 Proof Stress) | Tensile Strength | Total Elongation |
|---|---|---|---|---|---|---|---|---|
| C | Si | Mn | P | S | mm | kg/mm$^2$ | kg/mm$^2$ | % |
| 0.08 | 0.006 | 0.43 | 0.009 | 0.034 | 0.165 | 63.3 | 72.1 | 3.0 |
| 0.12 | 0.009 | 0.47 | 0.009 | 0.025 | 0.173 | 68.1 | 75.9 | 3.0 |
| 0.08 | 0.004 | 0.41 | 0.016 | 0.030 | 0.165 | 55.7 | 71.2 | 6.5 |

Remarks:

[1]Starting Material; A carbon steel strip coil containing cementite particles formed by repetition of cold working and annealing, and containing no pearlite.

[2]Treatment; Heated in the alpha-gamma range, i.e. between $A_1$ and $A_3$ transformation points, and water quenched (estimated cooling velocity would be 30000 – 40000° C/min.).

As another prior art for production of this kind of steel, Japanese Patent Publication Sho 31-1303 (A PROCESS FOR PRODUCING "MARTENO-FERRITE" STEEL) may be mentioned, according to which it is essential to heat a ferrite-pearlite steel with a heating rate of at least 100° C/sec. (6000° C/min.) up to the completion of the $Ac_1$ transformation, and it is also essential to introduce drastic quenching immediately. However, such a rapid heating can be realized only in a laboratory using a very small test piece and an appropriate heating means, but it is almost impossible to apply such a rapid heating to the commercial production of press-formable steel sheets by a continuous annealing apparatus.

The extremely rapid heating and cooling required by the above prior arts are essential for preventing the steel from taking the heat cycle to and from the alpha-gamma range in a quasi-equilibrium manner (namely for preventing carbon diffusion accompanying the heat cycle) so as to attain martensitic transformation of the carbon concentrated phase formed in the alpha-gamma range. Therefore, if it is possible to process a steel through the heat cycle (with mild rates of heating and cooling) in a non-equilibrium manner (sufficient to cause the eventual matensitic transformation) in respect to carbon diffusion by a practical and feasible metallurgical means, as a substitute for the severe rapid heating and cooling, it is possible to realize a ferrite-martensite dual-phase steel with a practically applicable heating rate and a cooling rate mild enough to eliminate both the shape deterioration and large capical investment. Naturally it is necessary that the transformed phase after cooling is uniformly dispersed in view of mechanical isotropy and good elongation. If a dual-phase steel satisfying the above conditions can be realized, remarkable industrial advantages can be assured for the production of a low-cost high-strength and high-ductility steel sheet.

The present inventors have solved the above problem based on the discovery of an optimum value of the proportions of Si and Mn in the high-silicon high-manganese dual-phase steel previously invented by the present inventors. Namely the present inventors completed the prior invention: (1) on the basis of the fact that an isotropic dispersion of the pearlite prior to the alpha-gamma-range heating can be obtained by appropriate proportions of Si and Mn, and (2) on the basis of the consideration that Si would be effective for controlling the carbon diffusion, preventing the austenite decomposition into pearlite. As a result, the present inventors succeeded in the prior invention to obtain a ferrite-martensite dual-phase structure after cooling from the alpha-gamma range, without drastic quenching (any heating rate is applicable and any cooling rate not lower than 100° C/min. is applicable), with the remarkable advantages that the ductility is excellent within a tensile strength range up to about 90 kg/mm$^2$, and that the remarkable increase in yield strength can be obtained by a low temperature reheating treatment or by baking for surface coating treatment after pressing. The advantage that such a structure and properties can be obtained by a relatively slow cooling following the alpha-gamma-range heating is based on an appropriate content of carbon as well as appropriate content of silicon and manganese.

The prior invention made by the present inventors is an excellent method for obtaining a good combination of high strength and high ductility, applicable to rather thick cold rolled sheets, up to about 2 mm, as well as to a thin steel sheet of less than about 1 mm thickness.

However, the present inventors have found through experiments that the relatively high content of silicon in the prior invention causes some problems in the production process, such as deterioration of the nature of scale at the rough hot rolling, even though it is not too difficult to commercially produce the objective products. It is also desirable to lower the silicon content from a point of view of production cost. Further, this prior invention has some problems due to high silicon content, regarding adhesivity of inorganic phosphate coatings applied onto the cold rolled sheets.

When the silicon content is lowered, it is very natural that controlling effect on the carbon diffusion is lowered. However, if the steel sheet is thin enough the air cooling rate becomes considerably large so that it is expected that pearlite formation (due to carbon diffusion) by the decomposition of the austenite phase formed in the alpha-gamma range is likely to be prevented. Therefore, it is considered that isotropic dispersion of the carbon concentrated phases (pearlite and/or carbide phases) prior to the alpha-gamma-range heating must be attained by some means other than the high silicon content.

Demands have been made for development of a method for producing a steel sheet (of dual-phase structure) having a good combination of strength and ductility properties, similar to those obtained by the prior invention made by the present invention, from a steel composition of low silicon content as in ordinary Si-Mn steels, particularly for the object of producing a high strength steel sheet of small thickness (about 1 mm) for forming.

The present invention has been completed to meet the above demand.

SUMMARY OF THE INVENTION

The object of the present invention is to provide a method for producing a steel of dual-phase structure of ferrite-martensite without severe rapid heating and drastic-quenching before and after the alpha-gamma-range heat treatment, using materials with a silicon content similar to or lower than that in an ordinary Si-Mn steel, thus solving the problems relating to the afore-mentioned high-silicon steel.

Particularly in recent years, it has long been desired in the automotive industry to develop such a steel as that having a low yield strength combined with a high tensile strength and high ductility (thus very advantageous for press forming) and showing remarkably increased yield strength when subjected to low temperature aging (utilizing heat of paint baking) after the forming. Such a steel sheet has been regarded by the automotive industry as an ideal material for forming automobile parts. The high-Si-Mn steel sheet as continuously annealed in the alpha-gamma-range which the present inventors developed previously has a dual-phase structure of ferrite-martensite and has a low yield strength and a large initial work hardening rate and a high tensile strength, excellent ductility, and remarkably increased yield strength due to low temperature reheating, thus satisfying the requirements of the ideal steel material sought by the automotive industry. The steel sheet produced by the present invention, having a lower or no silicon content, belongs to the same category of dual-phase structure as the high Si-Mn steel, and thus involves the same ideal.

The features of the present invention lie in the following pretreatments before the continuous annealing in the alpha-gamma temperature range. The pretreatments are, either (1) or (2), as follows:

1. Pre-annealing: a cold rolled steel sheet or hot rolled steel sheet is subjected to annealing by heating to the alpha-gamma temperature range, or 2. Alpha-gamma-range rolling: during the production process of the hot rolled steel sheet as a starting material, the sheet is subjected to finish rolling with a reduction not higher than 40% in the alpha-gamma temperature range, then coiled at a desired temperature, preferably at 550° C or lower, then optionally subjected to further cold rolling.

After the pretreatment of either (1) or (2), the sheet steel is subjected to continuous annealing in the alpha-gamma temperature range, whereby a dual-phase steel sheet composed of ferrite phase and rapidly-cooled-transformed phase is produced.

The finish rolling in the above feature (2) may be performed by using the last stand or last plural stands of the continuous hot rolling process, or may be done by a separate treatment through off-line rolling devices (in this case, an ordinarily hot rolled steel sheet is used as the starting material; therefore heating is needed before rolling in the alpha-gamma-range).

With regard to the hot-rolling performance in a continuous rolling process (hot-strip tandem-mill line process), it is worth mentioning that the recent trend in the actual operation indicates that the slab heating temperature is maintained lower than ever from an viewpoint of saving heating energy, so that the finishing temperature of the hot rolling may tend to be lower than $Ar_3$ transformation temperature. The present invention can take advantage of this tendency, contrary to the ordinary hot rolling process where the tendency should create some difficulties.

DETAILED DESCRIPTION OF THE INVENTION

The present invention will be described in more detail referring to the attached drawings.

Figure 1:
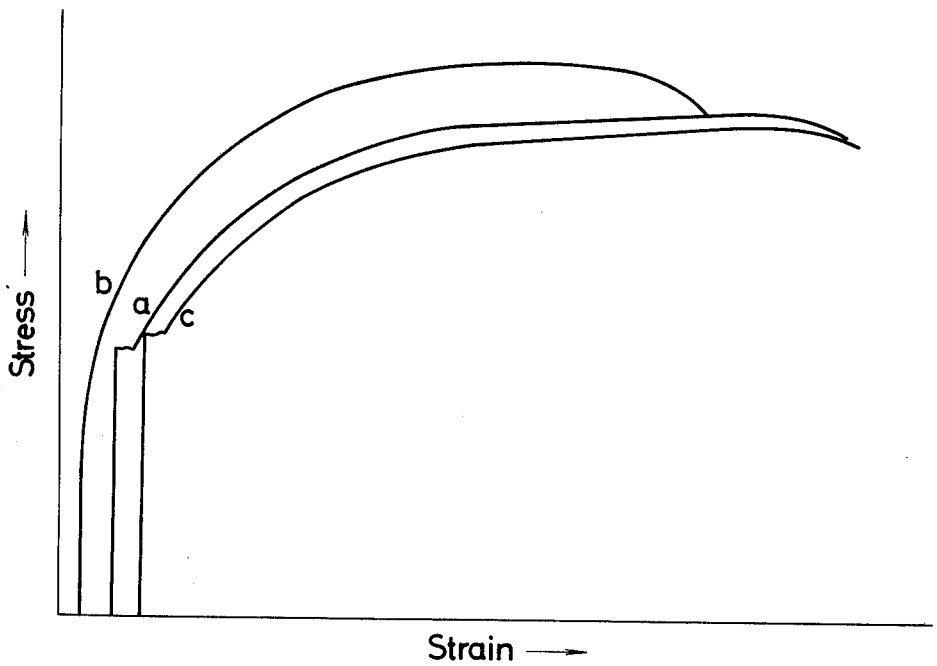
FIG. 1 is a graph showing effects of pretreatments prior to the alpha-gamma-range-continuous annealing on the stress-strain curve of the continuously annealed material.
Figure 3:
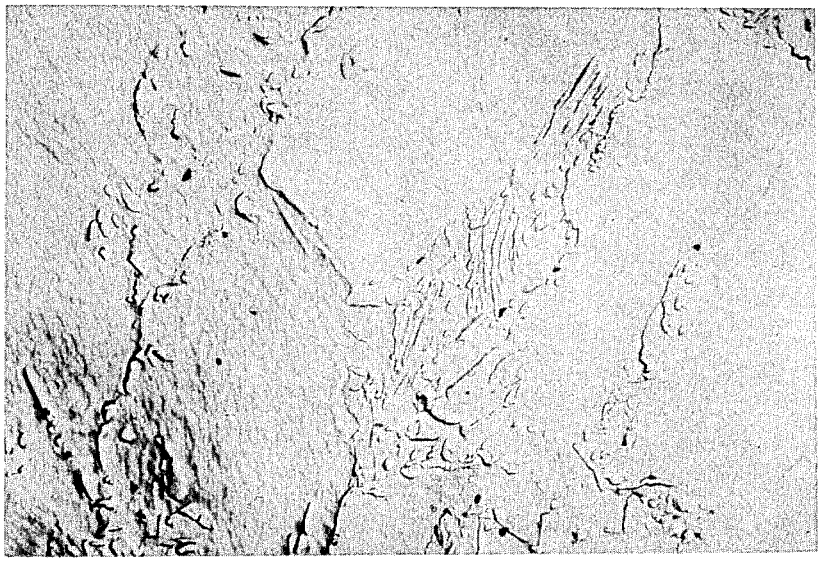
FIG. 3 is an electron microphotograph showing a microstructure of a steel (Steel C; 0.15% C and 1.51% Mn-Table 2, No. 3) which has been simply (i.e. without pretreatment) continuously annealed in the alpha-gamma range and air cooled.

When cold rolled steel sheets of various compositions shown in Table 2 are simply heated in the alpha-gamma-range and air cooled, the resulting properties are as shown in Table 2 and a structure mainly of ferrite and fine pearlite (FIG. 3) is obtained. When a steel of such structure is subjected to tensile tests, the stress-strain curve takes the form as shown in FIG. 1 (*a*) indicating nothing curious. Therefore, the present inventors have studied various pretreatment conditions which can adjust the structure prior to the alpha-gamma-range continuous annealing so as to assure isotropic dispersion of the carbon concentrated phases, and hence bring about the appropriate dispersion of rapidly-cooled-transformed phases in the ferrite matrix in the eventual alpha-gamma-continuously annealed sheet. The present inventors have discovered that when the pretreatment such as the afore-mentioned (1) or (2) is used and then the alpha-gamma-range continuous annealing is carried out, as desired structure and material quality can be obtained. The stress-strain curve of a steel sheet obtained by introducing either of the above pretreatments is as shown in FIG. 1 (*b*), which shows a lower yield strength without a definite yield point, a higher tensile strength and better combination of tensile strength and elongation, as compared with the curve (*a*).

DESCRIPTION OF PREFERRED EMBODIMENTS

The present invention will be more clearly understood from the following examples. However, the present invention should not be limited to these examples.

EXAMPLE 1

Results obtained by the pre-annealing of cold- or hot rolled steel sheets followed by the continuous annealing in the alpha-gamma range and air cooling are shown in Table 3.

When the pre-annealing temperature is in the single alpha range (Table 3, No. 9), the stress-strain curve after the alpha-gamma-range continuous annealing and air cooling is shown in FIG. 1 (*c*) which shows a strength lower than that obtained without the pretreatment (Table 2, No. 1). On the other hand, when the pre-annealing temperature is in the alpha-gamma-range (Table 3, Nos. 5, 6, 7, 8 and 10), generally increased tensile strength and at least similar or rather improved elongation as compared with those of the same steel without the pretreatment (Table 2, Nos. 1, 2, 3 and 4) are obtained. Meanwhile the yield strength is remarkably lowered and this indicates the attainment of the desired dual-phase structure.

It is also clear from the comparison between No. 5 steel and No. 10 steel in Table 3, which have a similar level of material quality, that the effect of the pretreatment is obtained irrespective of whether the steel is hot rolled or cold rolled. Based on the above results, the pre-annealing temperature for obtaining a dual-phase steel after the alpha-gamma-range continuous annealing and air cooling is limited to the alpha-gamma temperature range.

EXAMPLE 2

Table 4 shows results obtained by: rolling a steel in the alpha-gamma range or in the single alpha range, air cooling the sheet at a cooling rate of about 1000° C/min. to the room temperature, or to the coiling temperature followed by slow cooling, then directly or after cold rolling, continuously annealing in the alpha-gamma range and air cooling.

Figure 2:
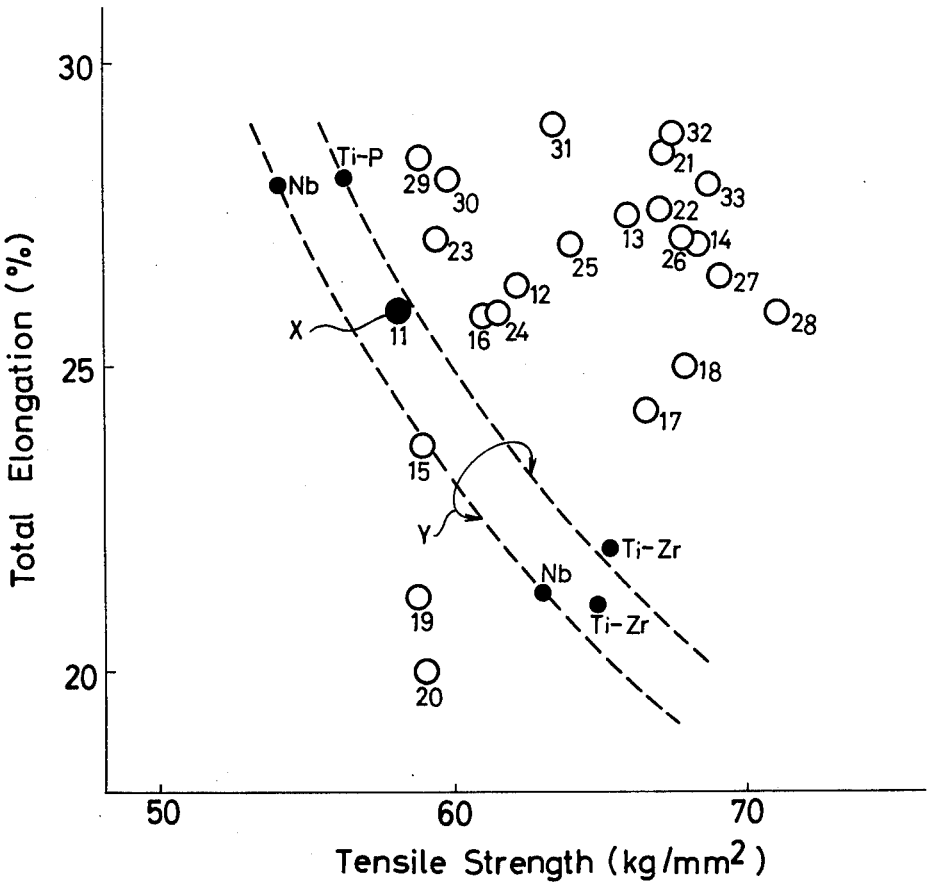
FIG. 2 is a graph showing strength and ductility of the alpha-gamma-range continuously annealed steel materials pretreated prior to the continuous annealing in comparison with strength and ductility of conventional high-strength steels.

When compared with the steel (No. 11) which was simply continuously annealed in the alpha-gamma range without the pretreatment, all of the steels except for No. 15 and No. 19 show clearly lowered yield strength and improved tensile strength. This clearly indicates the formation of a dual-phase structure. With regard to the elongation property, it is necessary to evaluate it with reference to the tensile strength as illustrated in FIG. 2, in which the tensile strength and elongation data shown in Table 4 are plotted in comparison with those of various conventional high-strength formable steel sheets in Table 5. For the conventional high-strength steel sheets, the ductility level with reference to the strength is shown by the broken line in FIG. 2. It is clearly understood that most of the data values shown in Table 4 are higher than the ductility level of the conventional steel sheets.

Meanwhile the samples No. 15 and No. 19 do not show the afore-mentioned lowering of the yield strength (Table 4) and do not show good elongation with reference to tensile strength. Also the sample No.20 shows very poor ductility. Therefore, these cases such as No. 15, No. 19 and No. 20 are excluded from the scope of the present invention.

Thus, regarding the rolling temperature range, the single alpha range (No. 20) is excluded therefrom so that the rolling temperatures are limited to the alpha-gamma range. Regarding the rolling reduction, it is limited to 40% or less because when the reduction reaches 50%, the material deteriorates (No. 15 and No. 19).

As for the coiling temperatures, those higher than about 600° C (No. 23, No. 24, No. 29 and No. 30) give slightly lowered improvement of properties possibly due to incomplete attainment of isotropic dispersion of the high-carbon phase, owing to the tendency of the steel sheet toward forming a banded structure. Therefore, it would be desirable that the coiling treatment is done at a temperature not higher than about 550° C (No. 25, No. 26, No. 27, No. 28, No. 31, No. 32 and No. 33), but there is no specific limitation on the coiling temperature because clear improvements can be obtained at any coiling temperature. Also the desired results of the present invention can be obtained irrespective of the cold rolling prior to the alpha-gamma-range continuous annealing. Since similar results can be obtained both when the alpha-gamma-range rolling is done during the course of cooling from the complete gamma range, and when it is done after reheating to the rolling temperature (No. 28), there is no limitation on the heat history prior to the alpha-gamma-range rolling.

Figure 4:
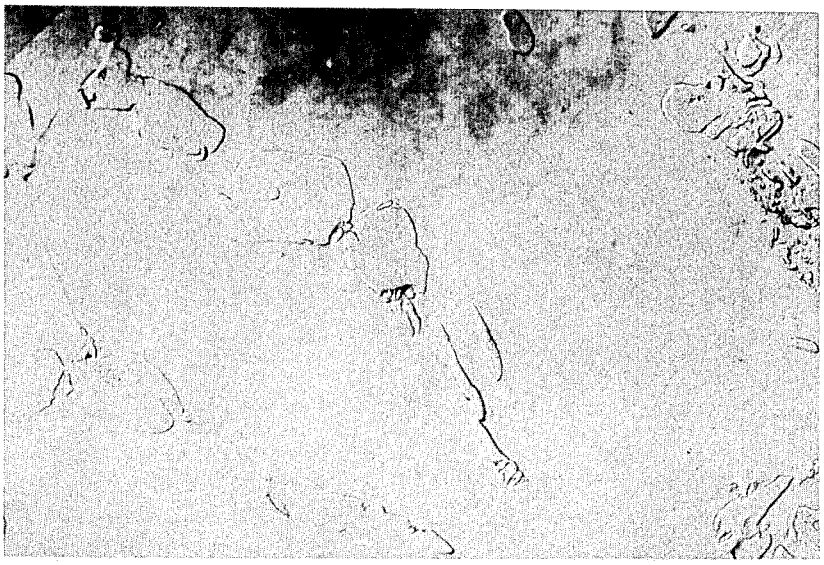
FIG. 4 is an electron microphotograph of a dual-phase structured steel (Steel C; 0.15% C, 1.51% Mn) according to the present invention.

One example of the electron microscopic structure of a dual-phase steel produced according to the present invention is shown in FIG. 4. As compared with the ferrite-fine pearlite structure shown in FIG. 3, it is clear that the dual-phase steel of the present invention contains the rapidly-cooled-transformed structure.

The steel sheets produced according to the present invention are low-yield-strength and high-tensile steel which is particularly applicable to press forming, and can give considerable improvement of yield strength by utilizing the forming strain and the paint baking heat. For illustration, increases of the yield strength after pre-strain and aging at 200° C are shown in Table 6. It is clear that the age hardenability after working of the steel sheets of the present invention is excellent.

Further according to the present invention, it is also possible to obtain a steel sheet product having high yield strength and high tensile strength before forming and aging. This can be attained by a short-time reheating at about 400° C of the low-yield-strength and high-tensile-strength steel sheet obtained after the alpha-gamma-range continuous annealing and air cooling, or by giving shelfing at about 300° C during the air cooling. Examples are shown in Table 7.

Theoretical analysis of the present invention may be given as follows.

As described hereinbefore, the isotropic dispersion of the carbon concentrated phase prior to the alpha-gamma-range heating is one of the prerequisites for obtaining a dual-phase steel. The pre-annealing in the alpha-gamma range is considered to attain its object through the formation of well-distributed fine and dense pearlite patches at the ferrite grain boundaries. The alpha-gamma-range rolling is considered to attain its object through the isotropic distribution of the gamma phase. Since the carbon concentration in the gamma phase at the alpha-gamma range heating in the eventual continuous annealing is required to be as high as possible in non-equilibrium manner, it is required that the high carbon phase before the continuous annealing is made into such a state as to dissolve into the ferrite matrix as "sluggishly" as possible during heating to and holding at an alpha-gamma temperature in the eventual continuous annealing process.

The pearlite phase formed by the alpha-gamma-range pre-annealing, or the pearlite phase produced by the coiling treatment, particularly at a temperature between 500° C and 550° C, after the alpha-gamma-range rolling is considered to satisfy the above requirements. In case of such pretreatments, lowering of the yield strength after the eventual alpha-gamma-range continuous annealing is especially noticeable (see Table 3 and Table 4).

From the same analysis, it is considered that when the dispersion of the high carbon phase before the eventual alpha-gamma-range continuous annealing is excessively fine, the total area of the interfaces between the high carbon particles and ferrite matrix becomes too large, so that quasi-equilibrium diffusion of carbon accompanying the heat cycle will be ready to occur and thus the above conditions are not satisfied. When the temperature of pre-annealing is in the single alpha range, too finely dispersed spheroidized cementite particles appear within the ferrite grains. When the reduction of the alpha-gamma range rolling is 50% or more, the dispersion of the gamma phase becomes too fine. These are examples of undesirable pretreatment. As for the cooling rate for preventing the diffusive decomposition of austenite (pearlite formation) during cooling in the eventual alpha-gamma-range continuous annealing, natural air cooling of the steel sheet of up to about 1 mm is sufficient in the present invention. Naturally, the present invention can also be applied to a thicker steel sheet, if a simple auxiliary cooling means such as by blowing cooling gas is employed.

Table 2

Strength and Ductility of Steel Sheets Continuously Annealed in the Alpha-Gamma Range and Air Cooled

| Process | | Hot Rolling Finished at 900° C or more | | | → | Cold Rolling 67% Reduction to 1 mm thick | | → | | Heating in the Alpha-Gamma Range at 800° C for 5 min. Followed by Air Cooling | | |
|---|---|---|---|---|---|---|---|---|---|---|---|---|
| | | Composition (% by weight) | | | | | | Transformation Point $Ac_3$ / $Ac_1$ (° C) | Sheet Thickness mm | Yield Strength kg/mm² | Tensile Strength kg/mm² | Total Elongation % |
| No. | Grade | C | Si | Mn | P | S | Al | | | | | |
| 1 | A | 0.16 | 0.46 | 1.49 | 0.014 | 0.008 | 0.029 | 850 | 1.0 | 41.5 | 58.1 | 25.9 |
| 2 | B | 0.11 | <0.02 | 1.49 | <0.01 | 0.008 | 0.028 | 870 | 1.0 | 32.3 | 49.0 | 32.8 |
| | | | | | | | | 690 | | | | |
| 3 | C | 0.15 | <0.02 | 1.51 | <0.01 | 0.008 | 0.031 | 860 | 1.0 | 37.2 | 53.9 | 30.9 |
| | | | | | | | | 720 | | | | |
| 4 | D | 0.10 | <0.02 | 1.98 | <0.01 | 0.008 | 0.031 | 855 | 1.0 | 30.2 | 61.4 | 25.5 |
| | | | | | | | | 715 | | | | |

Remarks:
Tensile Test : According to JIS 13-B Test Piece
Gauge Length 50 mm Parallel to the Rolling Direction Table 3

Example 1
Strength and Ductility of Steel Sheets Pre-Annealed and Continuously Annealed in the Alpha-Gamma Range and Air Cooled

| No. | Grade | Transformation Point $Ac_3$ $Ac_1$ (° C) | Cold Rolling Reduction (%) | Conditions of Pre-Annealing | Conditions of Alpha-Gamma Range Continuous Annealing | Sheet Thickness mm | Yield Strength (0.2% Proof Stress) kg/mm² | Tensile Strength kg/mm² | Total Elongation (%) |
|---|---|---|---|---|---|---|---|---|---|
| 5 | A | 850<br>710 | 67 | Cooled in Furnace 750° C/h. | Air Cooled 800° C 5 min. | 1.0 | 28.2 | 74.2 | 25.4 |
| 6 | B | 870<br>690 | " | Cooled in Furnace 750° C/h. | Air Cooled* 800° C 5 min. | " | 19.6 | 52.1 | 35.3 |
| 7 | C | 860<br>720 | " | " | " | " | 18.3 | 56.7 | 31.9 |
| 8 | D | 855<br>715 | " | " | " | " | 27.8 | 66.7 | 27.2 |
| 9 | A | 850<br>710 | " | Cooled in Furnace 650° C/h. | " | " | 45.1 | 57.8 | 29.2 |
| 10 | A | 850<br>710 | 0<br>(as hot rolled) | Cooled in Furnace 750° C/h. | " | " | 28.8 | 71.6 | 29.1 |

Remarks:
Tensile Test : According to JIS 13-B Test Piece; Gauge Length 50 mm Parallel to the Rolling Direction
No. 10: Originally 3 mm thick as hot rolled; machined to 1 mm thick before the experimental continuous annealing
*Air Cooling Rate 1000° C/min. (800 to 300° C)

Table 4

Example 2
Strength and Ductility of Steel Sheets, Alpha-Gamma-Range Rolled and Continuously Annealed in the Alpha-Gamma Temperature Range, and Air Cooled
Test Piece : Steel A as Hot Rolled (C:0.16%, Si:0.46%, Mn:1.49% $Ar_3$ 760° C $Ar_1$ 640° C)

| No. | Treating Conditions | Rolling Conditions: Rolling Temp. (° C) | Reduction (%) | Coiling Temp. (° C) | Yield Strength kg/mm² | Tensile Strength kg/mm² | Total Elongation % | Remarks |
|---|---|---|---|---|---|---|---|---|
| 11 | Cold Rolling→Alpha-Gamma-Range Continuous Annealing and Air Cooling | — | — | — | 44.9 | 58.1 | 25.9 | Ordinary Treatment |
| 12 | Austenitization→Rolling →Alpha-Gamma-Continuous Annealing and Air Cooling | 735 | 3 | Room Temp. | 32.2 | 62.2 | 26.3 | Rolled in the upper half portion of the alpha-gamma-range |
| 13 | | 745 | 10 | " | 35.6 | 66.0 | 27.5 | |
| 14 | | 730 | 30 | " | 38.1 | 68.4 | 27.0 | |
| 15 | | 725 | 50 | " | 45.5 | 58.9 | 23.7 | |
| 16 | | 675 | 5 | " | 30.4 | 61.0 | 25.8 | Rolled in the lower half portion of the alpha-gamma-range |
| 17 | | 685 | 10 | " | 32.8 | 66.5 | 24.3 | |
| 18 | | 690 | 30 | " | 34.9 | 67.9 | 25.0 | |
| 19 | | 680 | 50 | " | 47.0 | 58.8 | 21.2 | |
| 20 | | 600 | 30 | " | 38.7 | 59.0 | 20.0 | Rolled in the single alpha-range |
| 21 | Austenitization→Rolling →Cold Rolling→Alpha-Gamma-Continuous Annealing and Air Cooling | 730 | 30 | Room Temp. | 38.1 | 67.2 | 28.5 | Rolled in the upper half portion of the alpha-gamma range |
| 22 | | 680 | 30 | " | 37.6 | 67.1 | 27.6 | Rolled in the lower half portion of the alpha-gamma-range |
| 23 | Austenitization→Rolling →Coiling→Alpha-Gamma-Continuous Annealing and Air Cooling | 725 | 10 | 610 | 31.6 | 59.4 | 27.1 | Rolled in the upper half portion of the alpha-gamma-range |
| 24 | | 740 | 30 | 595 | 33.9 | 61.5 | 25.9 | |
| 25 | | 735 | 3 | 550 | 28.8 | 64.1 | 27.0 | |
| 26 | | 730 | 10 | 550 | 30.5 | 67.9 | 27.1 | |
| 27 | | 730 | 30 | 560 | 31.0 | 69.1 | 26.5 | |
| 28 | Heating to 760° C and Rolling→Coiling→Alpha-Gamma-Continuous Annealing and Air Cooling | 760 | 30 | 530 | 31.7 | 71.0 | 25.9 | |
| 29 | Austenitization→Rolling →Coiling→Cold Rolling→ Alpha-Gamma-Continuous Annealing and Air Cooling | 735 | 10 | 610 | 30.2 | 58.9 | 28.4 | Rolled in the upper half portion of the alpha-gamma-range |
| 30 | | 720 | 30 | 600 | 31.7 | 59.8 | 28.1 | |
| 31 | | 730 | 3 | 520 | 27.9 | 63.5 | 29.0 | |
| 32 | | 740 | 10 | 505 | 28.4 | 67.5 | 28.8 | |
| 33 | | 725 | 30 | 510 | 29.8 | 68.8 | 28.0 | |

Remarks:
1) Tensile Test:According to JIS 13-B Test Piece, Gauge Length 50mm,,Parallel to the Rolling Direction, 1mm thick
2) Austenitization: 900° C 30 min
3) Cooled at 1000° C/min after Finishing to Coiling
4) Condition of the Alpha-Gamma-Range Continuous Annealing: 800° C for 5 minutes, Cooling Rate 1000° C/min (800 to 300° C)
5) For No. 12-20, 23-28, 3mm thick rolled sheet was machined to 1mm thickness and subjected to experimental continuous annealing in the Alpha-Gamma-Range.

Table 5

Mechanical Properties of Various Conventional Formable High-Strength Steel Sheets

| Type | Composition (%) C | Si | Mn | P | Ti | Nb | Zr | Sheet Thickness mm | Yield Strength kg/mm² | Tensile Strength kg/mm² | Total Elongation % | Remarks |
|---|---|---|---|---|---|---|---|---|---|---|---|---|
| Nb | 0.12 | 0.26 | 1.28 | 0.01 | | 0.045 | | 1.0 | 43.2 | 54.0 | 28.0 | Cold rolled and annealed sheet |
| Ti-P | 0.09 | 0.31 | 1.27 | 0.08 | 0.04 | | | " | 42.5 | 56.3 | 28.1 | " |
| Ti-Zr | 0.10 | 0.61 | 1.51 | 0.01 | 0.25 | | 0.04 | " | 53.9 | 64.9 | 21.1 | " |
| Ti-Zr | 0.10 | 0.59 | 1.55 | 0.01 | 0.28 | | 0.04 | " | 52.3 | 65.3 | 22.0 | " |
| Nb | 0.13 | 0.26 | 1.36 | | | 0.055 | | 1.6 | 50.1 | 63.0 | 21.3 | Hot rolled sheet |

Remarks:
Tensile Test; According to JIS 13-B Test Piece
Gauge Length 50 mm Parallel to the Rolling Direction Table 6

Increase in Yield Strength $B_1$ Pre-strain and Aging

| Grade | Conditions of Annealing | (1) Yield Strength kg/mm² | (2) Stress at 10% Pre-strained kg/mm² | (2) was aged at 200° C for 30 min. kg/mm² | (3) - (1): Increase of Yield Strength kg/mm² |
|---|---|---|---|---|---|
| A | Table 2 No. 1 (Simple alpha-gamma-range continuous annealing) | 41.5 | 55.6 | 61.1 | +19.6 |
| | Table 3 No. 5 (Pretreatment → Alpha-gamma-range (continuous annealing) | 28.2 | 57.9 | 63.2 | +35.0 |
| B | Table 2 No. 2 (Simple alpha-gamma-range (continuous annealing) | 32.3 | 46.7 | 50.9 | +18.6 |
| | Table 3 No. 6 (Pretreatment → Alpha-gamma-range (continuous annealing) | 19.6 | 49.0 | 53.8 | +34.2 |

Remarks:
Tensile Test; According to JIS 13-B Test Piece
Gauge Length 50 mm Parallel to the Rolling Direction Table 7

Changes in Tensile Properties due to a Low-Temperature Reheating after Air Cooling or to a Shelfing During Air Cooling of the Alpha-Gamma-Range Continuously Annealed Sheets

| Type | Treatment | Yield Strength kg/mm² | Tensile Strength kg/mm² | Total Elongation % |
|---|---|---|---|---|
| A | Table 3 No. 5 (Pretreatment → Alpha-gamma-range continuous annealing air cooled) | 28.2 | 74.2 | 25.4 |
| | 300° C/15 min. shelfing during air cooling of alpha-gamma-range continuously annealed | 44.5 | 67.7 | 26.4 |
| | 400° C/5 min. after air cooling of the alpha-gamma-range continuously annealed | 45.3 | 65.9 | 27.1 |
| B | Table 3 No. 6 (Pretreatment → Alpha-gamma-range continuous annealing air cooled) | 19.6 | 52.1 | 35.3 |
| | 400° C/5 min. after air cooling of the alpha-gamma-range continuously annealed | 35.8 | 49.7 | 36.8 |

Remarks:
Tensile Test; According to JIS 13-B Test Piece
Gauge Length 50 mm Parallel to the Rolling Direction, Sheet Thickness 1.0 mm

What is claimed is:

1. A method for producing a steel sheet having a dual-phase structure composed of (b 1) a ferrite phase and (2) a transformed phase member selected from the group consisting of (a) a martensite phase, (b) a bainite phase and (c) both a martensite phase and a bainite phase, which method comprises pretreating a steel sheet, containing 0.03 to 0.15% carbon, 0.7 to 2.0% manganese and less than 0.7% silicon, by finish hot rolling the steel sheet with a finishing temperature only in the alpha-gamma temperature range, with a reduction not higher than 40% in the alpha-gamma temperature range, and coiling the finish hot rolled-steel sheet, continuously annealing the pretreated steel sheet in the alpha-gamma temperature range, and cooling the annealed steel sheet at a rate not higher than about 10,000° C/min.

2. A method according to claim 1, in which a hot rolled steel sheet is used as a starting material.

3. A method according to claim 1, in which the pretreatment further comprises cold rolling after coiling.

4. A method according to claim 1, which further comprises reheating the annealed, cooled steel sheet.

5. A method according to claim 1, which further comprises shelfing during the cooling of the annealed steel sheet.

6. A method according to claim 1, wherein coiling is carried out at a temperature not higher than 550° C.

7. A method according to claim 4, wherein reheating is carried out at about 400° C.

8. A method according to claim 5, wherein shelfing is carried out at about 300° C.

* * * * *